US006778674B1

(12) United States Patent
Panasik et al.

(10) Patent No.: US 6,778,674 B1
(45) Date of Patent: Aug. 17, 2004

(54) HEARING ASSIST DEVICE WITH DIRECTIONAL DETECTION AND SOUND MODIFICATION

(75) Inventors: Carl M. Panasik, Garland, TX (US); Thomas M. Siep, Garland, TX (US); Trudy D. Stetzler, Houston, TX (US); Pedro R. Gelabert, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/473,755

(22) Filed: Dec. 28, 1999

(51) Int. Cl.[7] ..... H04R 25/00

(52) U.S. Cl. ..... 381/313; 381/315; 381/317; 381/321

(58) Field of Search ..... 381/312, 313, 381/314, 315, 23.1, FOR 142, FOR 127, FOR 128, 316, 317, 321, 320, 92, 356

(56) References Cited

U.S. PATENT DOCUMENTS 4,449,018 A 5/1984 Stanton ..... 179/107
5,479,522 A * 12/1995 Lindemann et al. ..... 381/68
6,389,142 B1 * 5/2002 Hagen et al. ..... 381/313

* cited by examiner

*Primary Examiner*—Curtis Kuntz
*Assistant Examiner*—Brian Ensey
(74) *Attorney, Agent, or Firm*—Ronald O. Neerings; Wade James Brady, III; Frederick J. Telecky, Jr.

(57) ABSTRACT

A hearing assist device (10) for a person (P). The device comprises a speaker device (SP1) for presenting sound to an ear canal of the person and circuitry for identifying a specified area relative to the person. The device further comprises a first microphone (M1) for providing a first sound signal in response to a first sound source located inside the area and in response to a second sound source located outside the area. Further, the device comprises a second microphone (M2) for providing a second sound signal in response to the first sound source and the second sound source. Still further, the device comprises circuitry (16) for determining a position of the first sound source and the second sound source in response to the specified area, the first sound signal and the second signal. Finally, the device comprises circuitry (16) for outputting a processed signal in response to the position. In operation, the speaker device is operable to present processed sound to the ear canal in response to the processed signal, wherein the processed sound represents a different suppression of sound from the second sound source relative to sound from the first sound source.

69 Claims, 5 Drawing Sheets

HEARING ASSIST DEVICE WITH DIRECTIONAL DETECTION AND SOUND MODIFICATION

CROSS-REFERENCE TO RELATED APPLICATION

Not applicable

STATEMENT REGARDING FEDERALLY SPONSORED RESEARCH OR DEVELOPMENT

Not applicable

BACKGROUND OF THE INVENTION

The present embodiment related to hearing assist devices such as hearing aids, headset, and the like, and are more particularly directed to improving the ability of such devices to present a selection of sounds based on the directionality of the sound source.

Contemporary hearing assist devices take many forms that amplify sounds external from the wearing of the device and then present the amplify to the wearer. Moreover some of these devices also use technology to prevent or lower the devices use a bandpass filter to pass only the speech frequency portion of the external sound to the wearer of the device, thereby attempting to reduce or eliminate the chance that the user will hear sounds other than speech. As another example, some hearing assist devices use adaptive signal processing technology to remove interfering sound regardless of the direction of the sound. This devices implement a single microphone to achieve this functionality, and are sometimes sold in airports.

By way of further background, U.S. Pat. No. 4,449,018, entitled "Hearing Aid," issued May 15, 1984 ("the '018 patent), and the discusses a device for providing a directional sense to a human based on sound originating in different vertical locations relative to the human. More particularly, the '018 patent discloses a structure that fully encloses the pinna of the human ear. Two microphone are mounted externally to the enclosing structure and vertically with respect to one another. Similarly to transducers (i.e., speaker) are mounted internally within the enclosing structure and also vertically with respect to one another. Finally, a circuit to process signals from the microphone, or from other sources, so that sound signals are presented to the two different vertically-oriented speakers, thereby providing dissimilar sounds to the ear based on sound emitted in different vertical planes. The '018 patent also very briefly discusses an approach were the above-described structure is duplicated for both ears, that is, such that each ear has a two-microphone, two-speaker structure, and each structure then provides vertically differing sounds to a respective ear of the person wearing the structures.

While the above-described systems provide certain advantages to limit the scope of sounds provided to the device wearer, the present inventors have recognized that these devices provide drawbacks in that they do not fill a still existing need in the field of hearing assistance. Specifically, many prior art devices do not account for the directionality of sounds relative to the wearer of the device, while the present inventors have determined that by locating the direction of the sound source(s), the sound actually presented the user may be modified in view of that directionality. Further, if the sound presented to the wearer does not account for directionality of the desires of the user, the resulting presented sounds may be distracting and indeed may be a limitation on the ability of the wearer to appreciate information provided to the wearer due to the influence or emphasis that directionality otherwise imparts on sound information. Further, this loss may be complicated by other device limitations. For example, in the case of a typical amplify-only hearing aid, the presence of the physical hearing aid in the ear canal disrupts the focusing and sound directionality (i.e., horn) aspect of the outer ear and ear canal. As a result, the ability to concentrate upon sound is lost. Moreover, often the fit of the hearing aid changes over time, which may further distort or affect the loss of directionality. Lastly, in connection with its dual-ear structure, the '018 patent purports to address different sounds appearing in the same horizontal plane as the human wearing the device; however, the '018 patent is silent on what functionality is used to accomplish this result, or the way in which it is achieved.

In view of the above, there arises a need to address the drawbacks of the prior art and to provide an improved hearing assist device which presents its wearer with a sense of directionality or choice of directionality, as is achieved by the preferred embodiments discussed below.

BRIEF SUMMARY OF THE INVENTION

In the preferred embodiment, there is a hearing assist device for a person. The device comprises a speaker device for presenting sound to an ear canal of the person and circuitry for identifying a specified area relative to the person. The device further comprises a first microphone for providing a first sound signal in response to a first sound source located inside the area and in response to a second sound source located outside the area. Further, the device comprises a second microphone for providing a second sound signal in response to the first sound source and the second sound source. Still further, the device comprises circuitry for determining a position of the first sound source and the second sound source in response to the specified are, the first sound signal and the second signal. Finally, the device comprises circuitry for outputting a processed signal in response to the position. In operation, the speaker device is operable to present processed sound to the ear canal in response to the processed signal, wherein the processed sound represents a different suppression of sound from the second sound source relative to sound from the first sound source. Other circuits, systems, and methods are also disclosed and claimed.

DETAILED DESCRIPTION OF THE INVENTION

Figure 1A:
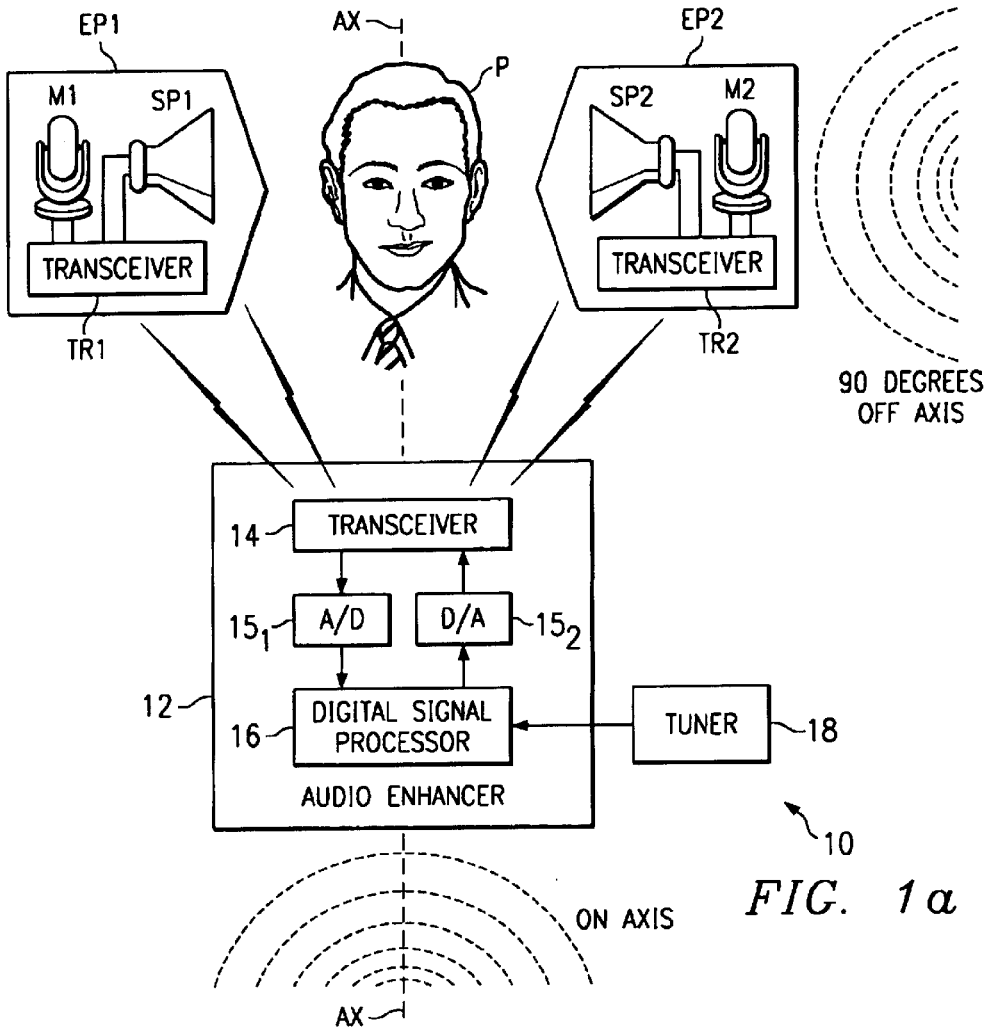
FIG. 1*a* illustrates a diagram of a person using a hearing assist device where the hearing assist device is shown in block diagram form and represents the preferred embodiment.

FIG. 1*a* illustrates a diagram of a person P using a hearing assist device where the hearing assist device is shown in block diagram form and represents the preferred embodiment. By way of introduction, generally the hearing assist device of FIG. 1*a* is identified at 10, with it understood that all blocks in FIG. 1*a* therefore demonstrate device 10. Further, note that device 10 is described in block form given that each block represents certain preferred functionality; from these blocks, therefore, certain preferred devices are set forth below for achieving the specified functionality. However, it is contemplated that one skilled in the art may determine various different circuits and software implementations to implement the preferred functionality of device 10, and such alternatives are also within the present inventive scope. Lastly, note that the term hearing assist device is used in this document not by limitation to devices for persons who are hearing impaired. Instead, the term hearing assist device is intended to apply to devices according to the present inventive teachings and may be used by any person seeking to obtain the benefits described below. Accordingly, hearing assist device 10 may take many forms, such as a hearing aid, a headset (with or without a mechanical band), or still others. Moreover, hearing device 10 may be a part of a headset device which also performs other functionality, such as a communicating headset or a part-time entertainment headset.

Looking to device 10, it includes two ear pieces EP1 and EP2, each for locating proximate (e.g., by insertion) a respective ear of person P. In the preferred embodiment, ear pieces EP1 and EP2 are electrically identical and have housing configurations that are physically mirror images of one another, thereby providing satisfactory shapes to accommodate both the left and right ear of a person wearing device 10. Further, the particular physical housing configuration of ear pieces EP1 and EP2 may be selected by one skilled in the art of such designs, while the electrical operation and functionality is described further with respect to to the present preferred embodiment. Thus, looking to ear piece EP1 by way of example, it includes a speaker SP1, a microphone M1, and a short-distance transceiver TR1. Similarly, since the electronics in ear piece EP2 are preferably identical to ear piece EP1, then ear piece EP2 includes a speaker SP2, a microphone M2, and a short-distance transceiver TR2. Each speaker SP1 and SP2 is oriented within ear pieces EP1 and EP2, respectively, so that sounds emitted by those speakers are directed into the ear canal of person P. Further in this regard, speakers SP1 and SP2 are preferably selected of appropriate dimension, type, and electrical characteristic so as to fit comfortably within or near the ear canal. In addition, these transducer devices are referred to as speaker devices only to suggest that they are capable of translating an electrical signal into an acoustic signal (e.g., an audible signal) detectable by the human ear, and not by way of limitation to a specific configuration or material. Each microphone M1 and M2 is oriented within ear pieces EP1 and EP2, respectively, so that it receives sounds external from and proximate the ear canal of person P. Further in this regard, microphones M1 and M2 are preferably selected of appropriate dimension, type, and electrical characteristic so as to fit comfortably near the ear canal while being directed to receive sounds external from the ear canal. Further and as detailed below, short distance transceiver TR1 permits microphone M1 and speaker SP1 to communicate via a wireless link to an audio enhancer 12, and similarly short distance transceiver TR2 permits microphone M2 and speaker SP2 to communicate via a wireless link to audio enhancer 12. Lastly, although not expressly shown in specific detail in FIG. 1*a*, it is intended that one skilled in the art will appreciate that ear piece EP1 and ear piece EP2 will further include any necessary circuitry to provide power and other connections needed relative to the devices shown within the ear piece so that those devices may provide the functionality described in this document.

In a preferred embodiment, audio enhancer 12 is formed in a housing separate from ear pieces EP1 and EP2 in order to physically accommodate the circuitry shown associated with audio enhancer 12. In this regard, audio enhancer 12 includes a transceiver 14, which preferably communicates in a wireless fashion at an RF frequency with the devices in ear pieces EP1 and EP2. More particularly and as detailed below, microphones M1 and M2 are operable to communicate signals to their respective short-distance transceivers TR1 and TR2 in response to sounds received by the microphones, and these signals are communicated by the respective transceivers TR1 and TR2 via a wireless link to transceiver 14. In the embodiment of FIG. 1*a*, this wireless link transmits data as analog data, but in an alternative embodiment described later the wireless link transmits digital data. In addition, after signal processing also described below, transceiver 14 communicates sound information to speakers SP1 and SP2 (via transceivers TR1 and TR2, respectively) which, in response, convert that information to sound waves which are presented to the ear canals of person P. Finally, in the preferred embodiment transceiver 14 is a short distance transceiver such that wireless communication between ear pieces EP1 and EP2 and audio enhancer 12 are achieved only across short distances; thus, audio enhancer 12 is preferably formed within a device or housing that may be conveniently located proximate person P (e.g., within a shirt pocket, on a nearby desk, on a necklace, and so forth.).

For purposes of accomplishing the signal processing introduced in the preceding paragraph, in the preferred embodiment audio enhancer 12 further includes a sound processing circuit which, in the preferred embodiment, is a digital signal processor ("DSP") 16. More particularly, in the embodiment of FIG. 1*a*, when transceiver 14 receives data representative of information received from microphones M1 and M2, that data is communicated to an analog-to-digital ("A/D") converter $\mathbf{15}_1$, which thereby digitizes the data and presents it to DSP 16. In this respect, note that a single A/D converter 15, is shown, but it should be understood that either a single such converter may be used to interleave the data from microphone M1 with the data of microphone M2, or as an alternative what is shown as A/D converter $\mathbf{15}_1$ may actually include two separate A/D converters, one for the data from microphone M1 and another for the data from microphone M2. Any of these approaches digitizes the microphone data and presents it to DSP 16 for processing. Further, after processing that information DSP 16 communicates sound data in digital form to a digital-to-analog ("D/A") converter 152, which thereby converts the data to analog form and presents it to transceiver 14. Like the A/D conversion, this D/A conversion may be achieved by interleaving the two data paths with a single D/A converter, or through the use of two separate D/A circuits for two respective data paths. In any event, once the analog data is provided to transceiver 14, then transceiver 14 communicates that data in a wireless fashion to speakers SP1 and SP2 (via transceivers TR1 and TR2, respectively) for presentation to person P. Note that any additional communication interface between transceiver 14 and DSP 16 depends on the circuitry used to implement these devices and may be selected from various alternatives by one skilled in the art. In addition to the preceding, DSP 16 operates in response to, among other things, at least one parameter relating to a spatial area described below. In this regard, DSP 16 is shown in FIG. 1*a* to communicate with a tuner 18, where tuner 18 is used in one embodiment to provide this parameter to DSP 16. In this embodiment, tuner 18 is manually adjustable by person P (or another person having access to audio enhancer 12) and, thus, to illustrate this embodiment tuner 18 is shown in FIG. 1*a* as external from audio enhancer 12. As detailed below, however, in alternative embodiments this spatial area parameter aspect may be fixed within audio enhancer 12 or provided to it in other manners.

Figure 1B:
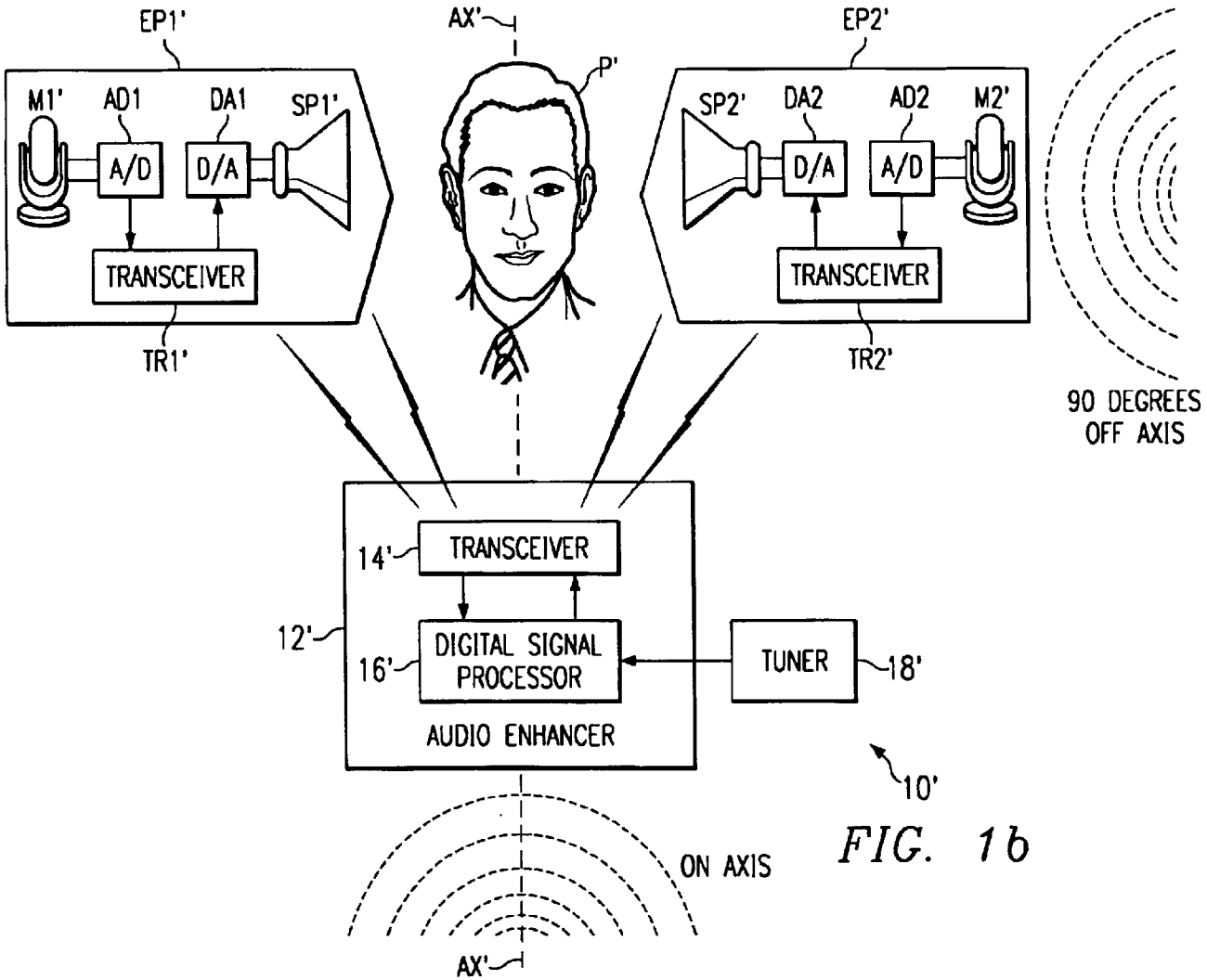
FIG. 1*b* illustrates the diagram of FIG. 1*a* with an alternative embodiment for the hearing assist device.

Before discussing the operation of device 10 in greater detail, FIG. 1*b* illustrates the diagram of FIG. 1*a* with an alternative embodiment for the hearing assist device; for the sake of comparison, like reference numbers and letters are carried forward from FIG. 1*a* into FIG. 1*b*, but apostrophes are added to those identifiers to avoid confusion between the present and earlier discussions. Thus, the hearing assist device of FIG. 1*b* is referenced generally at 10'. Looking briefly to the elements of device 10' in FIG.1*b* that were detailed above with respect to FIG. 1*a*, it includes two ear pieces EP1' and EP2', each of which is electrically identical to one another and which is a physical mirror image of the other. Device 10' also includes an audio enhancer 12' having a transceiver 14', a DSP 16', and a tuner 18'. The differences between device 10' of FIG.1*b* and device 10 of FIG. 1*a* are further discussed below.

The differences of device 10' arise in connection with its preferred technique for communicating data between ear pieces EP1' and EP2' to and from audio enhancer 12'; more particularly, for device 10', the data communicated is digital rather than analog as was the case discussed above with respect to device 10 of FIG. 1*a*. Specifically, for device 10' and looking to ear piece EP1' by way of example, microphone M1' provides its analog output to an A/D converter AD1 which converts the analog input into a digital form which is connected to transceiver TR1'. Ear piece EP2' is similar in that its microphone M2' provides its analog output to an A/D converter AD2 which converts the analog input into a digital form which is connected to transceiver TR2'. Transceivers TR1' and TR2' communicate the respective digital data via wireless links to transceiver 14' of audio enhancer 12'. Thereafter, transceiver 14' directly couples the received digital data to DSP 16'. Further, once DSP 16' processes the digital data, it returns resulting digital data to transceiver 14', which in response communicates this data to transceivers TR1' and TR2'. Looking at those transceivers, transceiver TR1' communicates its received digital data to a D/A converter DA1, which converts the digital data to analog form which is connected to speaker SP1', which therefore causes the sound data represented in the analog signal to be presented to a first ear of person P'. Similarly, transceiver TR2' communicates its received digital data to a D/A converter DA2, which converts the digital data to analog form which is connected to speaker SP2', which therefore causes the sound data represented in the analog signal to be presented to a second ear of person P'. From the preceding, therefore, one skilled in the art will appreciate the wireless transmission of data for device 10' is of digital data, whereas in contrast the transmission of analog data for device 10 of FIG. 1*a* is of analog data.

Figure 2:
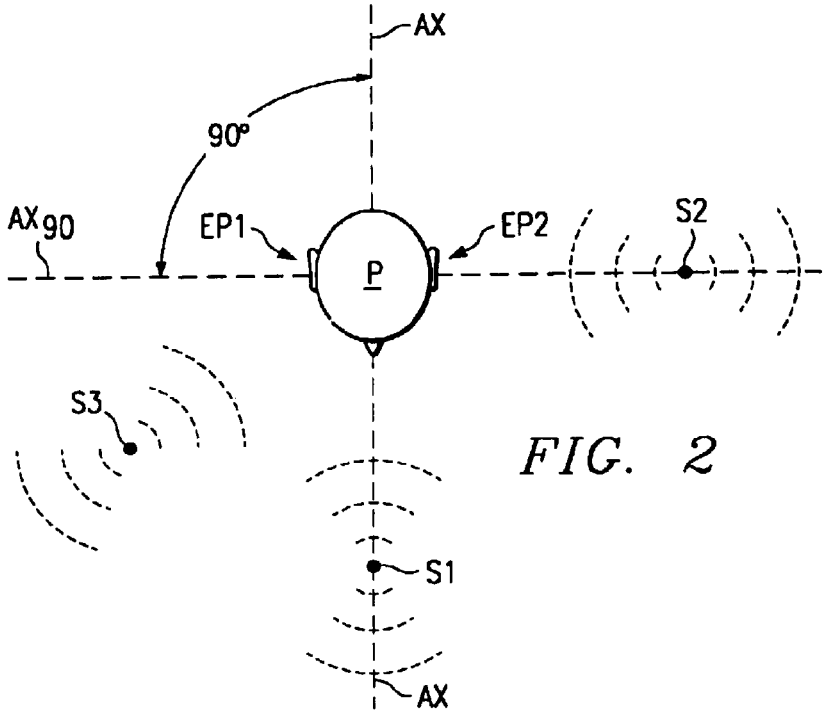
FIG. 2 illustrates a top view of the person in FIG. 1*a* using the preferred hearing assist device and further illustrates three sound sources, each providing sounds to the device from different directions.

To further facilitate a discussion of the operation of devices 10 and 10', reference is now made to FIG. 2, where the discussion by way of example is directed to device 10 and from which one skilled in the art will readily appreciate the comparable operation of device 10'. Specifically, FIG. 2 illustrates a top view of person P from FIG. 1*a*, and further indicates an imaginary axis AX which it is now noted is also shown in FIG. 1*a*. In both FIGS. 1*a* and 2, axis AX is defined as a line drawn generally in the direction which is orthogonal to both ear canals of person P and, more particularly for reasons explored below, is the line which is along the direct frontal vision of person P. To demonstrate different scenarios as achieved by the operation of device 10, FIG. 2 also illustrates three different sources of sound S1, S2, and S3, each located in different positions relative to axis AX. For example, source S1 is directly aligned with axis AX, as would be the expected case if person P were looking directly at source S1. As another example, source S2 is aligned along an axis $AX_{90}$, where axis $AX_{90}$ is ninety degrees off of axis AX. As a result, source S2 aligned directly in front of one of the ear pieces, and in the example shown it is aligned with ear piece EP2. Additionally, note that source S2, as being directly aligned with one ear piece (i.e., ear piece EP2), is therefore on the exact opposite side of the head of person P as is the opposing ear piece (i.e., ear piece EP1). Lastly, source S3 is generally between axis AX and axis $AX_{90}$ and, thus, is between zero and ninety degrees off of axis AX. For the following three examples, it is assumed for simplicity that only one of these sources of sound is active at a time, although the preferred embodiment operates in the same manner as described for concurrently active sound sources. Finally, as an introduction to the following discussion of the operation of device 10, note that such operation generally performs two steps, each of which is described separately below. First, device 10 distinguishes the directionality of a sound source (e.g., sources S1, S2, and S3). Second, device 10 selectively presents only sounds detected from certain directions to person P.

The operation of device 10 is now described, first using the example where source S1 emits sound while sources S2 and S3 are silent. The sound emitted from source S1 reaches microphones M1 and M2, and each of those microphones outputs a corresponding electrical signal to its respective transceiver TR1 and TR2. In response, each transceiver TR1 and TR2 transmits a wireless signal representation of the sound to transceiver 14. For the sake of reference, let the signal produced by microphone M1 in response to sound received from source S1 and transmitted by transceiver TR1 be designated as $M1_{S1}$, while the comparable signal from microphone M2 and transceiver TR2 is designated as $M2_{S1}$. Transceiver 14 in the preferred embodiment demodulates the wireless signals $M1_{S1}$ and $M2_{S1}$ and couples them to A/D converter $15_1$ and in response A/D converter $15_1$ produces two digital signals $DM1_{S1}$ and $DM2_{S1}$ corresponding to the signals $M1_{S1}$ and $M2_{S1}$, respectively. Moreover, A/ D converter $15_1$, communicates the $DM1_{S1}$ and $DM2_{S1}$ signals to DSP 16.

In the preferred embodiment, DSP 16 determines from the $DM1_{S1}$ and $DM2_{S1}$ signals the directionality of the sound source which produced these signals. Specifically, DSP 16 determines an amount of angular offset between the sound source and axis AX. In the preferred embodiment, the offset determination is made as detailed later, but as may be introduced generally here in response to a comparison of the time of arrival ("TOA") of each sound at its respective microphone. More particularly, the TOA analysis may be made in view of the corresponding $DM1_{S1}$ and $DM2_{S1}$ signals. Thus, for the example of source S1, DSP 16 compares the data per time slot in $DM1_{S1}$ with the data per time slot in $DM2_{S1}$. Since source S1 is the same distance from microphones M1 and M2, then the sound it emits should reach microphones M1 and M2 at the same time. As a result, both signals $DM1_{S1}$ and $DM2_{S1}$ should represent identical information, aligned in identical time slots (assuming the same electrical device characteristics of ear pieces EP1 and EP2, as also addressed later). In other words, each piece of data received by microphone M1 should be the same as the data received at the same time by microphone M2, and the above-described analysis of signals $DM1_{S1}$ and $DM2_{S1}$ will detect this alignment. As a result, DSP 16 determines that due to the match in TOA of the two signals, then the source emitting those signals is the same distance from each microphone and, hence, that source is aligned on axis AX. In other words, the angular offset from axis AX is determined to be zero.

Having determined the directionality of the sound source (e.g., S1), the preferred embodiment next operates to either present that sound to person P, or to suppress that sound from being presented to person P, where this result is hereafter referred to as "selective sound presentation" to person P. In the preferred embodiment, the choice of the selective sound presentation is based on the location of the sound source relative to person P. Further, in the preferred embodiment, this location is defined relative to person P by defining an axis relative to person P, and an area defined by an angular distance centered about that axis. These two aspects are both further explored below in connection with the example of sound source S1 as well as the other examples of sounds sources S2 and S3. Lastly, note also that these two aspects may be provided to DSP 16 in various fashions, including but not limited to by tuner 18. These different alternatives are also explored below.

Figure 3A:
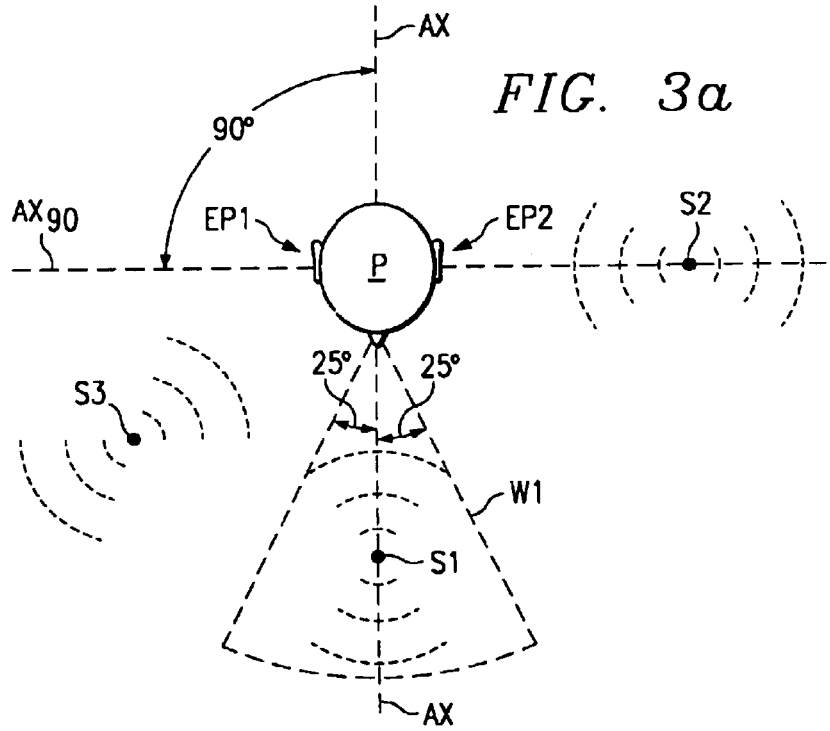
FIG. 3*a* illustrates the top view of FIG. 2 with a wedge W1 defined to exclude sounds emitted by sound sources S2 and S3 from being presented to person P.

FIG. 3*a* illustrates a first example of the selective sound presentation of the preferred embodiment, namely, where sound source S1 is presented to person P based on its location relative to an axis and an angular distance centered about that axis. Specifically, FIG. 3*a* illustrates an instance where DSP 16 operates to present sounds to person P where the source of those sounds is within an area defined by a wedge W1. Further, note that wedge W1 encompasses any sound source within a location defined by an angular offset of 50 degrees centered about axis AX. Wedge W1 is defined to DSP 16 in one embodiment by tuner 18, or alternatively it may be programmed into DSP 16 in some other fashion (e.g., at the time device 10 is built, or it may be programmable to be altered either at time of manufacture or later). Since sound source S1 is along axis AX, then it clearly falls within the area defined by W1; thus, DSP 16 causes the sounds emitted by source S1 to be presented to person P. More particularly, signals $DM1_{S1}$ and $DM2_{S1}$ are multiplied by DSP 16 times a like gain factor (i.e., amplified a like amount). For the sake of reference, the amplified signals are referred to as $ADM1_{S1}$ and $ADM2_{S1}$. Thereafter, the amplified signals $ADM1_{S1}$ and $ADM2_{S1}$ are converted to corresponding analog signals by D/A converter $15_2$, and then these corresponding signals are presented to transceiver 14 which modulates the signals and communicates them to speakers SP1 and SP2 (via transceivers TR1 and TR2), respectively. Thus, speakers SP1 and SP2 then present to person P sounds represented by the converted signals arising from the amplified signals $ADM1_{S1}$ and $ADM2_{S1}$, thereby presenting to person P the sounds from source S1.

Further examining FIG. 3*a*, note that sounds sources S2 and S3 are both outside of the area defined by wedge W1. As a result, for each of sound sources S2 and S3 in FIG. 3*a*, when they emit sound then DSP 16 determines the directionality of those sources, and thereby determines based on the TOA corresponding to each sound source that both of those sources are outside of wedge W1. Thereafter, DSP 16 prevents sounds from sources 52 and S3 from being presented to person P. In one preferred approach to achieving this result, DSP 16 attenuates these signals by applying a negative gain to the signals corresponding to sources S2 and S3 (i.e., $DM1_{S2}$ and $DM2_{S2}$ for source S2, $DM1_{S3}$ and $DM2_{S3}$ for source S3). Thus, the gain as applied with respect to sources S2 and S3, because they are outside of wedge W1, is lower than the gain as applied to source S1 because it is inside of wedge W1. In other words, sounds outside of the defined wedge (e.g., wedge W1) are selectively suppressed relative to sounds within the defined wedge. Further in this approach the results after applying the negative gain (i.e., $ADM1_{S2}$ and $ADM2_{S2}$ for source S2, $ADM1_{S3}$ and $ADM2_{S3}$ for source S3) may be transmitted to ear pieces EP1 and EP2 by transceiver 14, but due to their low gain they will not be presented in an audible fashion. In an alternative approach, DSP 16 takes advantage of the aspect that any sound within wedge W1 will have a maximum TOA as defined by wedge W1. Accordingly, in this alternative approach, DSP 16 does not amplify or does not return to transceiver 14 any received signals that have a TOA greater than the maximum as defined by the wedge at issue (e.g., wedge W1 in FIG. 3*a*). As still another approach, sounds detected outside of the wedge may be suppressed, such as by inverting the signal and adding it to the original signal, thereby producing a null. In all approaches, therefore, person P is not presented with sounds corresponding to sound sources outside of wedge W1.

Figure 3B:
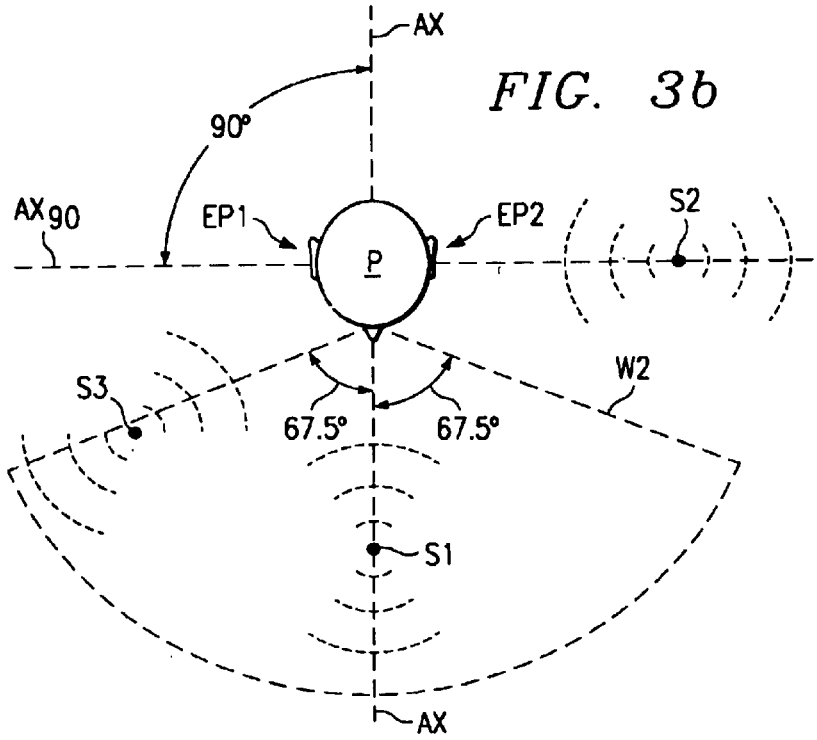
FIG. 3*b* illustrates the top view of FIG. 2 with a wedge W2 defined to exclude sounds emitted by sound source S2 from being presented to person P.

FIG. 3*b* again illustrates the same top view of FIG. 2, and presents an additional example to further demonstrate the operation of the preferred embodiment. In FIG. 3*b*, either tuner 18 or an alternative technique provides to DSP 16 an area defined by a larger arc angle of 135 degrees centered about axis AX, thereby giving rise to a wedge W2 (i.e., having 67.5 degree halves located to each side of axis AX). From the perspective of FIG. 3*b*, therefore, one skilled in the art will appreciate that wedge W2 encompasses both sound sources S1 and S3, but excludes sound source S2. Consequently, DSP 16 again performs the above-described methodology so that sounds emitted by source S2 are suppressed relative to sounds emitted by sources S1 and S3. Therefore, in the preferred embodiment, sounds emitted by source S2 and S3 are not presented to person P (or if presented, are presented in a lesser fashion). Further, sounds emitted by source S1 and S3 are preferably presented to person P to have an equal amount of amplification to both of ear pieces EP1 and EP2 as in the case described above with respect to FIG. 3*a* . However, further in connection with sounds emitted by source S3, they are processed by DSP 16, amplified, and transmitted by transceiver 14 to transceivers TR1 and TR2 so that speakers SP1 and SP2, respectively, present these sounds to person P to have the same relative TOA as when they arrived at microphones M1 and M2, respectively. Indeed, sound may be estimated to travel at approximately 1.25 milliseconds per foot; assuming the distance between the ears of an average adult is on the order of eight inches and applying this average to person P, then sound from source S3 reaches microphone M1 approximately 0.8 milliseconds before it reaches microphone M2. Thus, by maintaining this relative TOA when the sounds are then presented to person P, person P will perceive this same time-delay and therefore have the perspective that sound source S3 is offset from axis AX and is closer to ear piece EP1 than to ear piece EP2.

Figure 3C:
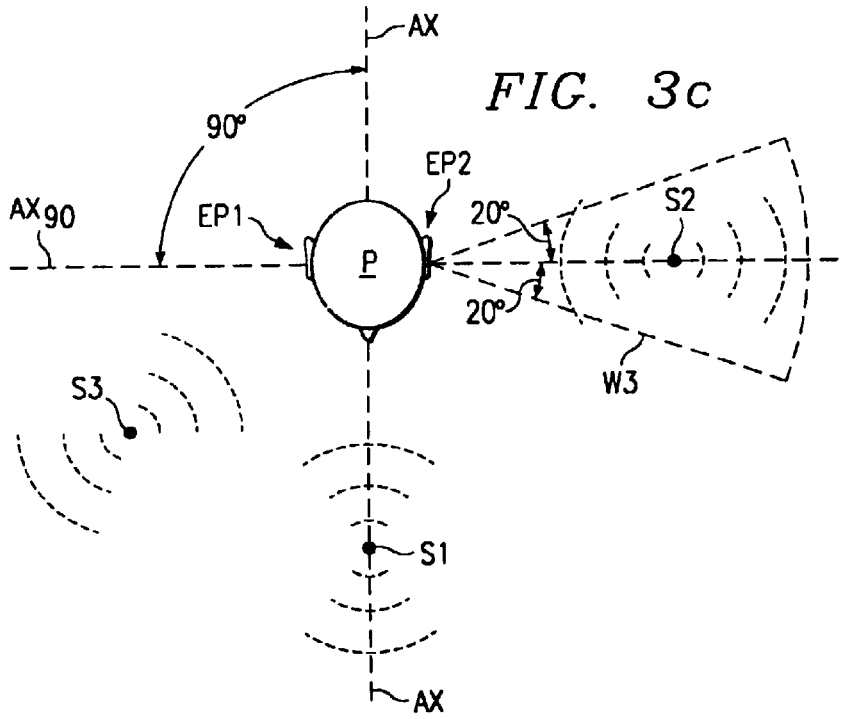
FIG. 3*c* illustrates the top view of FIG. 2 with a wedge W3 defined to exclude sounds emitted by sound sources S1 and S3 from being presented to person P.

FIG. 3*c* illustrates yet again the same top view of FIG. 2, and presents an additional example to demonstrate an alternative or additional aspect of the preferred embodiment. More particularly, recall now that it is stated above that the a wedge defined by the preferred embodiment is centered about an axis. Further in this regard, the examples of FIGS. 3*a* and 3*b* have shown axis AX as the axis relating to the sound-inclusive wedge. However, in FIG. 3*c*, DSP 16 uses a different axis, which by way of example is shown as axis $AX_{90}$ (although still other axes could be selected). Further, a wedge W3 is defined about axis $AX_{90}$, where in the example of FIG. 3*a*, wedge W3 is further defined by DSP 16 as having an arc angle of 40 degrees centered about axis $AX_{90}$. Accordingly, only sound sources within wedge W3 are presented to person P. Given the definition of wedge W3, then only sound source S2 is presented to person P while sounds sources S1 and S3 are excluded. Additionally, sounds emitted by source S2 are presented to person P to have the same relative TOA as when they arrived at microphones M1 and M2, respectively; thus, by maintaining this relative TOA, person P is presented with a same time-delay which therefore provides to person P a perspective that sound source S2 is located along axis $AX_{90}$ and is closer to ear piece EP2 than to ear piece EP1. Note further that the example of FIG. 3*c* is such that a person desiring to only hear sound sources to one of their sides may adjust tuner 18 and benefit from the overall operation of device 10.

Having demonstrated a preferred operation for tuner 18, note that various additional modifications are further contemplated within the inventive scope as relating to the tuner 18 aspect and the related aspect of a defined location based on an axis and angular displacement from that axis. As a first modification, tuner 18 as described above provides only a single arc angle which is used to define a single wedge of interest centered about an axis. However, in an alternative embodiment, tuner 18 may be modified to provide more than one wedge identifier, whereby additional wedges are located relative to other axes. In this respect, therefore, person P may define different zones of sound inclusion and sound exclusion. As another example, the wedge could be hard coded into DSP 16, or programmable via an electronic interface.

While the preceding operational discussion has been in the context of device 10 of FIG. 1*a*, one skilled in the art will readily appreciate how such operation may be modified to apply to device 10' of FIG. 1*b*. First, the preferred methods for detecting direction differences in TOA and for applying gain amplification levels is the same as described above. Second, however, such a modification should accommodate the wireless transmission of digital signals as is achieved by ear pieces EP1' and EP2', and audio enhancer 12'. In this case, therefore, let the signal produced by microphone M1' in response to sound received from a source S1, and converted to digital form by A/D converter AD1 and transmitted by transceiver TR1' be designated as $DM1_{S1}$, while the comparable signal from microphone M2', converted by A/D converter AD2, and transmitted by transceiver TR2 be designated as $DM2_{S1}$. Transceiver 14' couples these digital signals to DSP 16, which operates as described above relative to device 10. Thereafter, DSP 16 produces digital resulting and amplified signals, $ADM1_{S1}$ and $ADM2_{S2}$, which are transmitted, via transceiver 14', to respective D/A converters DA1 and DA2, and then respective sounds are presented to person P', via speakers SP1' and SP2', respectively.

Figure 4:
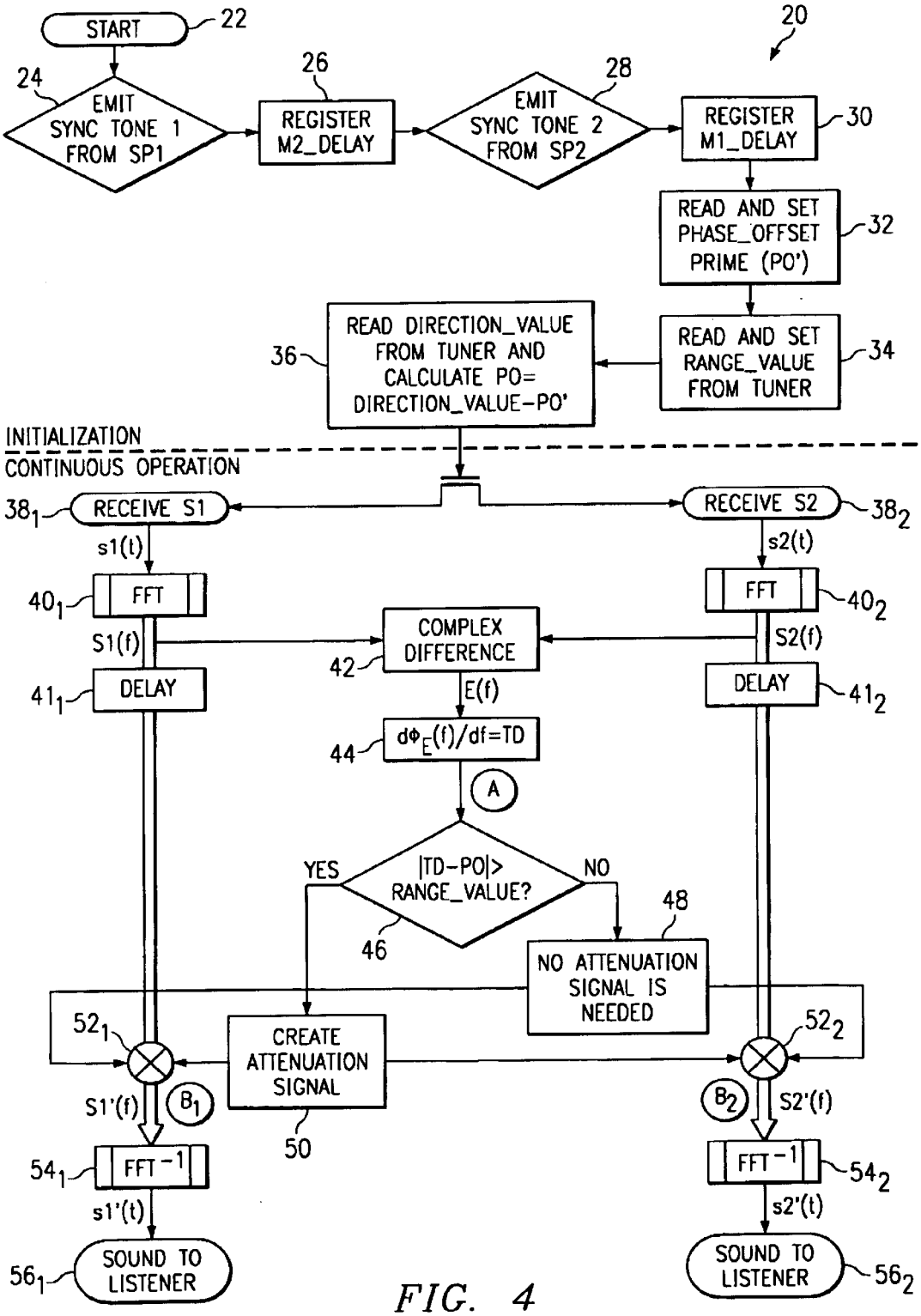
FIG. 4 illustrates a flow chart of a method of the preferred operation of the hearing assist device of FIG. 1*a*.

FIG. 4 illustrates a method 20 which further details a preferred embodiment for determining directionality of a sound source using a TOA analysis and selectively suppressing sound signals as introduced above. Method 20 begins with a series of steps 22 through 30 which initialize the operation and delay characteristics for ear pieces EP1 and EP2 and those steps are first described, with a later discussion of the remaining method steps which perform the TOA analysis and selective signal suppression in view of the initialization determinations. Further, in the preferred embodiment, method 20 is performed under the control of DSP 16.

Turning to the initialization steps, step 22 represents a start step, where preferably ear pieces EP1 and EP2 are removed from the ears of person P and placed next to one another. In step 24, speaker SP1 emits a test tone which is received by microphone M2 in ear piece EP2. DSP 16 measures the delay between the time that speaker SP1 emits the tone and the time it is received by microphone M2 and, in step 26, this delay ("M2_Delay") is stored in a register or the like. Steps 28 and 30 operate in reverse fashion. Thus, in step 28, speaker SP2 emits a test tone which is received by microphone M1 in ear piece EP1. DSP 16 measures the delay ("M1_Delay") between the time that speaker SP2 emits the tone and the time it is received by microphone M1 and, in step 30, M1_Delay is stored in a register or the like. In step 32, DSP 16 determines the difference between M2_Delay and M1_Delay, where this difference is referred to as Phase_Offset prime (PO'). Accordingly, PO' represents the delay characteristics of the set of devices (includes analog circuit delays and processing times) and sets the phase offset that remains unattenuated. Next, in step 34, a variable identified as Range_Value is read where, in the preferred embodiment, Range_Value defines the angular length about an axis to define a wedge as that aspect was detailed above. Thereafter, in step 36, a variable identified as Direction_Value is read where, in the preferred embodiment, Direction_Value defines the direction of the axis about which the Range_Value wedge is centered. Further, note that both the Direction_Value and Range_Value variables are converted to units of time delay. This conversion normalizes these values for use with other parameters in method 20. Indeed, also in step 36, a normalized value of Phase_Offset prime PO', where this normalized value is hereafter referred to as PO, is determined by subtracting PO' from the converted value of Direction_Value. Note, therefore, that the value of PO reflects the desired direction (i.e., Direction_Value) but is corrected for any device characteristic offset by subtracting PO'. Finally, PO and Range_Value are used to select the listening axis and wedge angle, respectively, as further appreciated below.

Figure 5:
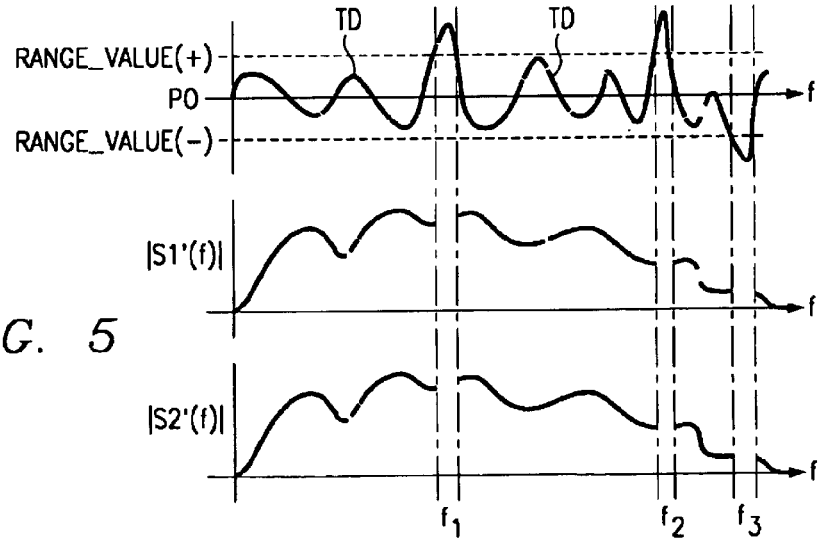
FIG. 5 illustrates a signal diagram demonstrating the difference of the input signals from the two microphones of the preferred hearing assist device in the frequency domain as well as the output signals arising from the method of FIG. 4.

Following the initialization steps, FIG. 4 illustrates two vertical parallel paths representing the separate and parallel operation with respect to ear piece EP1 to the left of FIG. 4 and ear piece EP2 to the right of FIG. 4. Thus, for the operation steps, ear pieces EP1 and EP2 are inserted into the ears of person P, and in parallel steps $38_1$ and $38_2$, each ear piece collects sound via its microphone, and data (either analog or digital) representative of that sound is communicated to DSP 16 (via the various alternatives discussed above). For the sake of reference, these time domain signals are shown in FIG. 4 as s1(t) from ear piece EP1 and s2(t) from ear piece EP2. Next, in steps $\mathbf{40}_1$ and $\mathbf{40}_2$, the time domain signals s1(t) and s2(t) are separately Fast Fourier Transformed (FFT) to produce corresponding signals in the frequency domain, represented as S1(f) and S2(f). Note that parallel delay elements $\mathbf{41}_1$ and $\mathbf{41}_2$ are shown in the two frequency domain channels which compensate for the calculation time of the center signal processing path. In step 42, the complex difference in the frequency domain of the S1(f) and S2(f) signals is determined because this difference provides information to be used to calculate the time difference between the signals. More particularly, the step 42 difference produces a signal E(f) which is used in step 44 where a derivative is taken of E(f) to determine the time delay TD; specifically, time delay TD as a function of frequency is the derivative of phase as a function of frequency. Next, in step 46, the delay in TD is compared relative to PO by subtracting PO from TD to yield a difference value. Further in step 46, the absolute value of the difference is compared against Range_Value, where recall that the latter defines the angular range of sounds which are to be presented to person P. To further demonstrate step 46, FIG. 5 illustrates the TD signal over the frequency range f, and further illustrates the positive and negative limits defined by Range_Value. The subtraction and absolute value performed in step 46 thereby identify any instances where TD extends beyond (i.e., above or below the positive and negative values, respectively) Range_Value. If no such instances exist, then method 20 continues to step 48 whereas if an instance exists where TD is beyond Range_Value, then method 20 continues to step 50.

From the preceding, step 48 is reached when the entire time delay relative to PO is within the borders of the positive and negative values of Range_Value. One skilled in the art will thus appreciate that this occurs when the delay between sound signals s1(t) and s2(t), as examined by their-frequency domain counterparts and adjusted to take into account PO', is sufficiently small to fall within a wedge that is defined by Range_Value about an axis defined by Direction_Value; in other words, sound signals s1(t) and s2(t) correspond to a sound source that is within the defined wedge. As a result, in step 48, no attenuation signal is applied. To achieve this lack of attenuation, a multiplier of 1 is coupled to multipliers $\mathbf{52}_1$ and $\mathbf{52}_2$. Multipliers $\mathbf{52}_1$ and $\mathbf{52}_2$ multiply the delayed frequency domain signals of S1(f) and S2(f) times the value of 1, thereby creating resulting signals S1'(f) and S2'(f), but the multiplier value of 1 causes the values of S1'(f) and S2'(f) to equal the values of S1(f) and S2(f), respectively. Next, the outputs of multipliers $\mathbf{52}_1$ and $\mathbf{52}_2$ are connected to corresponding inverse FFT blocks $\mathbf{54}_1$ and $\mathbf{54}_2$, thereby converting signals S1'(f) and S2'(f) to time domain counterparts, namely, s1'(t) and s2'(t). Finally, method 20 concludes with steps $\mathbf{56}_1$ and $\mathbf{56}_2$, where signals s1'(t) and s2'(t) are presented to person P, as may be achieved using the combination of transceiver 14 and other devices in ear pieces EP1 and EP2 described above.

Returning now to step 50, it is reached when one or more portions of the TD signal relative to PO are outside of the borders of the positive and negative values of Range_Value. For example, three such instances are shown in FIG. 5 at $f_1$, $f_2$, and $f_3$. One skilled in the art will thus appreciate that this occurs when the delay associated with $f_1$, $f_2$, and $f_3$ is attributable to sound sources giving rise to delays from a location outside of a wedge that is defined by Range_Value about an axis defined by Direction_Value; in other words, portions of sound signals s1(t) and s2(t) correspond to a sound source that is outside the defined wedge. As a result, in step 50, an attenuation signal is created. To achieve this attenuation, an appropriate attenuation multiplier is coupled to multipliers $\mathbf{52}_1$ and $\mathbf{52}_2$, which multiply the delayed frequency signals of S1(f) and S2(f) times the provided attenuation multiplier, thereby creating resulting signals S1'(f) and S2'(f). Here, however, the attenuation multiplier value causes the values of S1'(f) and S2'(f) to suppress and preferably exclude those frequency portions corresponding to f1, f2, and f3, as shown in the bottom two plots of FIG. 5. Next, the outputs of multipliers $\mathbf{52}_1$ and $\mathbf{52}_2$ are connected to corresponding inverse FFT blocks $\mathbf{54}_1$ and $\mathbf{56}_1$, thereby converting signals S1'(f) and S2'(f) to time domain counterparts, namely, s1'(t) and s2'(t). Finally, method 20 concludes with steps $\mathbf{56}_1$ and $\mathbf{56}_2$, where signals s1'(t) and s2'(t) are presented to person P, but in this case signals s1'(t) and s2'(t) will have suppressed any sounds in s1(t) and s2(t) that were emitted from a source or sources outside of the wedge defined by Direction_Value and Range_Value.

From the above, it may be appreciated that the above embodiments provide various improved hearing assist devices, which include by way of examples hearing aids, headsets, and the like. The improvements include the ability of such devices to selectively present and selectively suppress sound to a user based on the directionality of the source of those sounds. Other improvements arise in that while the present embodiments have been described in detail, various substitutions, modifications or alterations could be made to the descriptions set forth above without departing from the inventive scope. Indeed, various alternatives have been set forth above. As yet another alternative, while a TOA approach is preferred for determining the offset distance of a sound source from axis AX, other techniques may be used to determine the offset. As another alternative, while the preferred link between audio enhancer 12 and ear pieces EP1 and EP2 is wireless, a wired link is also contemplated. As still another example, note that the components of audio enhancer 12 may be shared with another electronic device (e.g., a cellular telephone), so that the functions of the other device may be combined with that of audio enhancer 12. As still another example, while the preferred embodiment uses two microphones, a third microphone may be added to device 10, such as locating it in audio enhancer 12, whereby additional data may be received from the third microphone, thereby permitting additional types of sound processing (e.g., triangulation). As yet another example, while the wedge or wedges described above have been used to define areas where sounds within those areas are included while sounds outside of those areas are suppressed or excluded, the opposite result also could be achieved, that is, where sounds within the wedge area were suppressed while sounds outside the wedge area were presented to person P. Finally, it is noted that as technology advances and device sizes reduce, device 10 may be incorporated into a smaller and more monolithic structure. For example, DSP 16 in the future may be formed of a size small enough to fit within one of ear pieces EP1 and EP2. The preceding additional examples further demonstrate the inventive scope, as is defined by the following claims.

What is claimed is:

1. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining, without using a lookup table, a specified area relative to said person, for determining a relative position of a source of said sound within said specified area and suppressing sounds received by said first and second microphones from outside said specified area, and for outputting a first processed signal to said first audio device and a second processed signal to said second audio device, said first and second processed signals being reflective of said determined relative position of said source of said sound within said specified area.

2. The hearing assist apparatus of claim 1, wherein a width of said specified area relative to said person is user modifiable.

3. The hearing assist apparatus of claim 1, wherein said first sound signal and said second sound signal are the same sound signal.

4. The hearing assist apparatus of claim 1, wherein negative gain is added to said sounds received by said first and second microphones from outside said specified area to facilitate said suppression.

5. The hearing assist apparatus of claim 1, wherein the signals from said sounds received by said first and second microphones from outside said specified area are added to an inverse of the signals to produce a null.

6. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining, without using a lookup table, a specified area relative to said person, for determining a relative position of a source of said sound within said specified area by comparing a time of arrival of the first sound signal with a time of arrival of the second sound signal, and for outputting a first processed signal to said first audio device and a second processed signal to said second audio device, said first and second processed signals being reflective of said determined relative position of said source of said sound within said specified area.

7. The hearing assist apparatus of claim 6, wherein said circuitry determines said relative position of said sound relative to an axis located between said first microphone and said second microphone.

8. The hearing assist apparatus of claim 7, wherein the axis is generally along a frontal line of vision of said person.

9. The hearing assist apparatus of claim 6, further comprising:

a first housing comprising said first audio device and said first microphone; and a second housing comprising said second audio device and said second microphone.

10. The hearing assist apparatus of claim 9, wherein said first housing further comprises a first wireless transceiver coupled to said first audio device and said first microphone and said second housing further comprises a second wireless transceiver coupled to said second audio device and said second microphone.

11. The hearing assist apparatus of claim 10, further comprising a third housing comprising said circuitry.

12. The hearing assist apparatus of claim 11, wherein said third housing further comprises a third wireless transceiver coupled to said circuitry for sending signals to and receiving signals from said first and second wireless transceivers.

13. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining, without using a lookup table, a specified area relative to said person, for determining a relative position of a source of said sound within said specified area, and for outputting a first processed signal to said first audio device and a second processed signal to said second audio device, wherein said first processed signal is delayed relative to said second processed signal in response to a delay between the time said first microphone receives said sound and said second microphone receives said sound, said first and second processed signals being reflective of said determined relative position of said source of said sound within said specified area.

14. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining a specified area relative to said person, for determining a relative position of a source of said sound within said specified area, for diminishing said first and second processed signals to the point of being unaudible to said person when said relative position of said source of said sound is outside said specific area, and for outputting a first processed signal to said first audio device and a second processed signal to said second audio device, said first and second processed signals being reflective of said determined relative position of said source of said sound.

15. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining a specified area relative to said person, for determining a relative position of a source of said sound within said specified area, and for outputting a first processed signal to said first audio device and a second processed signal to said second audio device, wherein said circuitry applies negative gain to said first and second processed signals when said relative position of said source of said sound is outside said specific area, said first and second processed signals being reflective of said determined relative position of said source of said sound.

16. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining a specified area relative to said person, for determining a relative position of a source of said sound within said specified area, and for outputting a first processed signal to said first audio device and a second processed signal to said second audio device, wherein said circuitry does not amplify said first and second processed signals to the point of being audible to said person when said relative position of said source of said sound is outside said specific area, said first and second processed signals being reflective of said determined relative position of said source of said sound.

17. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining a specified area relative to said person, for determining a relative position of a source of said sound within said specified area, and for outputting a first processed signal to said first audio device and a second processed signal to said second audio device, wherein said circuitry diminishes said first and second processed signals to the point of being unaudible to said person when said relative position of said source of said sound is inside said specific area, said first and second processed signals being reflective of said determined relative position of said source of said sound.

18. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining a specified area relative to said person, for determining a relative position of a source of said sound within said specified area, and for outputting a first processed signal to said first audio device and a second processed signal to said second audio device, wherein said circuitry applies negative gain to said first and second processed signals when said relative position of said source of said sound is inside said specific area, said first and second processed signals being reflective of said determined relative position of said source of said sound.

19. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining a specified area relative to said person, for determining a relative position of a source of said sound within said specified area, and for outputting a first processed signal to said first audio device and a second processed signal to said audio device, wherein said circuitry does not amplify said first and second processed signals to the point of being audible to said person when said relative position of said source of said sound is inside said specific area, said first and second processed signals being reflective of said determined relative position of said source of said sound.

20. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining a specified area relative to said person, for determining a relative position of a source of said sound within said specified area, and for outputting a first processed signal to said first audio device and a second processed signal to said second audio device, said first and second processed signals being reflective of said determined relative position of said source of said sound; and wherein a width of said specified area relative to said person is user modifiable.

21. The hearing assist apparatus of claim 14, wherein said first sound signal and said second sound signal are the same sound signal.

22. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining a specified area relative to said person, for determining a relative position of a source of said sound within said specified area by comparing a time of arrival of the first sound signal with a time of arrival of the second sound signal, and for outputting a first processed signal to said first audio device and a second processed signal to said second audio device, said first and second processed signals being reflective of said determined relative position of said source of said sound.

23. The hearing assist apparatus of claim 22, wherein the axis is generally along a frontal line of vision of said person.

24. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining a specified area relative to said person and for determining a position of a source of said sound relative to an axis other than generally along a frontal line of vision of said person, located between said first microphone and said second microphone within said specified area, and for outputting a first processed signal to said first audio device and a second processed signal to said second audio device, said first and second processed signals being reflective of said determined relative position of said source of said sound.

25. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining a specified area relative to said person, for determining a position of a source of said sound relative to a user selectable axis located between said first microphone and said second microphone within said specified area, and for outputting a first processed signal to said first audio device and a second processed signal to said second audio device, said first and second processed signals being reflective of said determined relative position of said source of said sound.

26. A hearing assist apparatus for a person, comprising:

a first audio device for presenting sound to an ear of said person;

a second audio device for presenting sound to another ear of said person;

a first microphone for providing a first sound signal in response to said first microphone receiving a sound;

a second microphone for providing a second sound signal in response to said second microphone receiving said sound; and circuitry, responsive to said first and second sound signals, for defining a specified area relative to said person, for determining a position of a source of said sound relative to an axis located between said first microphone and said second microphone within said specified area, and for outputting a first processed signal to said first audio device and a second processed signal to said second audio device wherein said first processed signal is delayed relative to said second processed signal in response to a delay between the time said first microphone receives said sound and said second microphone receives said sound, said first and second processed signals being reflective of said determined relative position of said source of said sound.

27. The hearing assist apparatus of claim 14, further comprising:

a first housing comprising said first audio device and said first microphone; and a second housing comprising said second audio device and said second microphone.

28. The hearing assist apparatus of claim 27, wherein said first housing further comprises a first wireless transceiver coupled to said first audio device and said first microphone and said second housing further comprises a second wireless transceiver coupled to said second audio device and said second microphone.

29. The hearing assist apparatus of claim 28, further comprising a third housing comprising said circuitry.

30. The hearing assist apparatus of claim 29, wherein said third housing further comprises a third wireless transceiver coupled to said circuitry for sending signals to and receiving signals from said first and second wireless transceivers.

31. The hearing assist apparatus of claim 4, wherein a width of said specified area relative to said person is user modifiable.

32. The hearing assist apparatus of claim 5, wherein a width of said specified area relative to said person is user modifiable.

33. The hearing assist apparatus of claim 6, wherein a width of said specified area relative to said person is user modifiable.

34. The hearing assist apparatus of claim 7, wherein a width of said specified area relative to said person is user modifiable.

35. The hearing assist apparatus of claim 8, wherein a width of said specified area relative to said person is user modifiable.

36. The hearing assist apparatus of claim 13, wherein a width of said specified area relative to said person is user modifiable.

37. The hearing assist apparatus of claim 9, wherein a width of said specified area relative to said person is user modifiable.

38. The hearing assist apparatus of claim 10, wherein a width of said specified area relative to said person is user modifiable.

39. The hearing assist apparatus of claim 11, wherein a width of said specified area relative to said person is user modifiable.

40. The hearing assist apparatus of claim 12, wherein a width of said specified area relative to said person is user modifiable.

41. The hearing assist apparatus of claim 4, wherein said first sound signal and said second sound signal are the same sound signal.

42. The hearing assist apparatus of claim 5, wherein said first sound signal and said second sound signal are the same sound signal.

43. The hearing assist apparatus of claim 6, wherein said first sound signal and said second sound signal are the same sound signal.

44. The hearing assist apparatus of claim 7, wherein said first sound signal and said second sound signal are the same sound signal.

45. The hearing assist apparatus of claim 8, wherein said first sound signal and said second sound signal are the same sound signal.

46. The hearing assist apparatus of claim 13, wherein said first sound signal and said second sound signal are the same sound signal.

47. The hearing assist apparatus of claim 9, wherein said first sound signal and said second sound signal are the same sound signal.

48. The hearing assist apparatus of claim 10, wherein said first sound signal and said second sound signal are the same sound signal.

49. The hearing assist apparatus of claim 11, wherein said first sound signal and said second sound signal are the same sound signal.

50. The hearing assist apparatus of claim 12, wherein said first sound signal and said second sound signal are the same sound signal.

51. The hearing assist apparatus of claim 15, wherein said first sound signal and said second sound signal are the same sound signal.

52. The hearing assist apparatus of claim 16, wherein said first sound signal and said second sound signal are the same sound signal.

53. The hearing assist apparatus of claim 17, wherein said first sound signal and said second sound signal are the same sound signal.

54. The hearing assist apparatus of claim 18, wherein said first sound signal and said second sound signal are the same sound signal.

55. The hearing assist apparatus of claim 19, wherein said first sound signal and said second sound signal are the same sound signal.

56. The hearing assist apparatus of claim 20, wherein said first sound signal and said second sound signal are the same sound signal.

57. The hearing assist apparatus of claim 24, wherein the axis is generally along a frontal line of vision of said person.

58. The hearing assist apparatus of claim 25, wherein the axis is generally along a frontal line of vision of said person.

59. The hearing assist apparatus of claim 26, wherein the axis is generally along a frontal line of vision of said person.

60. The hearing assist apparatus of claim 27, wherein the axis is generally along a frontal line of vision of said person.

61. The hearing assist apparatus of claim 28, wherein the axis is generally along a frontal line of vision of said person.

62. The hearing assist apparatus of claim 29, wherein the axis is generally along a frontal line of vision of said person.

63. The hearing assist apparatus of claim 30, wherein the axis is generally along a frontal line of vision of said person.

64. The hearing assist apparatus of claim 15, further comprising:

a first housing comprising said first audio device and said first microphone; and a second housing comprising said second audio device and said second microphone.

65. The hearing assist apparatus of claim 16, further comprising:

a first housing comprising said first audio device and said first microphone; and a second housing comprising said second audio device and said second microphone.

66. The hearing assist apparatus of claim 17, further comprising:

a first housing comprising said first audio device and said first microphone; and a second housing comprising said second audio device and said second microphone.

67. The hearing assist apparatus of claim 18, further comprising:

a first housing comprising said first audio device and said first microphone; and a second housing comprising said second audio device and said second microphone.

68. The hearing assist apparatus of claim 19, further comprising:

a first housing comprising said first audio device and said first microphone; and a second housing comprising said second audio device and said second microphone.

69. The hearing assist apparatus of claim 20, further comprising:

a first housing comprising said first audio device and said first microphone; and a second housing comprising said second audio device and said second microphone.

* * * * *